US007882828B2

(12) United States Patent
Skinner et al.

(10) Patent No.: US 7,882,828 B2
(45) Date of Patent: Feb. 8, 2011

(54) IGNITION APPARATUS WITH CYLINDRICAL CORE AND LAMINATED RETURN PATH

(75) Inventors: Albert A. Skinner, El Paso, TX (US); Edgard Wolf, Chihuahua (MX); Colin J. Hamer, El Paso, TX (US); André V. Scaff, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 128 days.

(21) Appl. No.: 12/325,581

(22) Filed: Dec. 1, 2008

(65) Prior Publication Data

US 2010/0132677 A1 Jun. 3, 2010

(51) Int. Cl.
*H01F 38/12* (2006.01)
*H01F 38/00* (2006.01)

(52) U.S. Cl. ..... 123/634

(58) Field of Classification Search ..... 123/621, 123/634, 635, 647; 336/90, 92, 96
See application file for complete search history.

(56) References Cited

U.S. PATENT DOCUMENTS

| | | | | |
|---|---|---|---|---|
| 1,421,286 | A * | 6/1922 | Milton | 123/635 |
| 1,545,429 | A | 7/1925 | Hunt | |
| 5,015,982 | A | 5/1991 | Skinner et al. | |
| 5,285,760 | A | 2/1994 | Takaishi et al. | |
| 6,178,957 | B1 | 1/2001 | Widiger et al. | |
| 6,213,109 | B1 * | 4/2001 | Satoo et al. | 123/634 |
| 6,428,645 | B1 | 8/2002 | Rau | |
| 6,463,918 | B1 | 10/2002 | Moga et al. | |
| 6,463,919 | B1 * | 10/2002 | Skinner et al. | 123/634 |
| 6,614,108 | B1 | 9/2003 | Sanftleben et al. | |
| 6,679,236 | B2 | 1/2004 | Skinner et al. | |
| 7,049,923 | B2 * | 5/2006 | Skinner et al. | 336/90 |
| 2003/0160601 | A1 * | 8/2003 | Lenhard et al. | 324/117 H |
| 2004/0027222 | A1 | 2/2004 | Hazelwood et al. | |
| 2006/0119459 | A1 | 6/2006 | Skinner et al. | |

OTHER PUBLICATIONS

PCT International Search Report dated Jan. 26, 2010.

* cited by examiner

*Primary Examiner*—Mahmoud Gimie
(74) *Attorney, Agent, or Firm*—Thomas N. Twomey

(57) ABSTRACT

An ignition apparatus includes a cylindrical core made from magnetically-permeable material and a C-shaped magnetic return path structure that is made from a stack of silicon steel laminations. A tightly controlled air gap is provided between one leg of the C-shaped structure and an end face of the core, forming a magnetic circuit having a high magnetic permeability, which overall reduces the number of primary winding turns needed, thereby reducing the amount of copper wire. In addition, the circular cross-section of the core reduces the mean length per turn (MLT) of the primary winding because the primary winding can be wound directly on the core, which in turn also reduces the MLT of the secondary winding. The reduced MLT also reduces the amount of copper wire. The structure may be replaced using a magnetically-permeable, U-shaped shield.

16 Claims, 2 Drawing Sheets

IGNITION APPARATUS WITH CYLINDRICAL CORE AND LAMINATED RETURN PATH

TECHNICAL FIELD

The present invention relates generally to an ignition apparatus or coil, and, more particularly, to an ignition apparatus that uses less copper wire than conventional arrangements.

BACKGROUND OF THE INVENTION

There has been much investigation in the development of an ignition apparatus for producing a spark for ignition of an internal combustion engine. As a result, the art has developed a variety of different configurations suited for many different applications. In general, it is known to provide an ignition apparatus that utilizes a high-voltage transformer that includes a magnetically-permeable core and primary and secondary windings. It is typical to use copper wire for the primary and secondary windings.

While there has always been an incentive to reduce the amount of copper wire in an ignition coil (and hence the cost attributable to copper), in the past few years, the price of copper has increased over 400%, with the result that the cost of the copper wire in an ignition coil has become a significant portion of the total bill of materials (BOM). A couple of approaches are known in the art that have an effect on the amount of copper wire used in an ignition coil. One approach is to wind the primary winding directly onto a round magnetic core and thus eliminate a primary spool, which reduces the diameter of the primary winding turns, and thus the mean length per turn (MLT). For a comparable number of turns, this approach reduces the amount of copper wire. This approach also reduces the MLT of the secondary winding for the same reason, thereby also reducing the amount of copper wire attributable to the secondary winding. For the first approach, the magnetic core is circular in shape and is typically used with an open magnetic path configuration (i.e., a magnetic circuit with large air gaps). Another approach is to provide a magnetic core that is rectangular in cross-section, and that is provided generally in two-piece configuration with either a "C-I" or "E-I" shape. In this second approach, an air gap is provided, but is generally very tightly controlled resulting in a structure with a high magnetic permeability. The rectangular cross-section used in this second approach requires a primary spool for the primary winding and therefore increases the MLT of both the primary and secondary windings. However, the relatively high magnetic permeability of the core structure allows for a reduced number of turns as compared to the first approach. For example, U.S. Pat. No. 6,679,236 entitled "IGNITION SYSTEM HAVING A HIGH RESISTIVITY CORE" issued to Skinner et al. is illustrative of the first approach and discloses a round core with the primary winding wound directly onto the outer surface of the core. As a further example, U.S. Pat. No. 5,285,760 entitled "IGNITION COIL DEVICE FOR AN INTERNAL COMBUSTION ENGINE" issued to Takaishi et al. disclose a C-shaped laminated steel core, illustrative of the second approach described above. Notwithstanding the state of the art, there continues to be a need to reduce the amount of copper wire used in an ignition coil in order to control cost.

Accordingly, there is a need for an ignition apparatus for an internal combustion engine that minimizes or eliminates one or more of the shortcomings described above.

SUMMARY OF THE INVENTION

One advantage of the present invention is that it reduces the amount of copper wire used as compared to conventional ignition coils for comparable performance. The present invention achieves this advantage by providing a winding structure that allows for the use of a circular-shaped magnetic core (i.e., where the primary winding can be wound directly around the core to reduce the MLT) in combination with a return structure that provides a high permeance magnetic path (i.e., which generally permits a reduction in the number of turns). Overall, the amount of copper wire used, and hence copper material, is reduced.

In one embodiment, an ignition apparatus is provided that includes a magnetically-permeable core, a primary winding, a secondary winding and a magnetically-permeable structure defining a high permeance magnetic return path. The core is generally cylindrical, extends along an axis, and has a pair of end surfaces on axially-opposite ends thereof. The core thus has a circular shape in radial cross-section. Accordingly, the mean length per turn (MLT) is reduced relative to other arrangements, as described in the Background. The structure, which comprises a stack of silicon steel laminations, may be roughly in a C-shape, and have a base and a pair of legs that extend from the base. The core is positioned so that the end surfaces face the pair of legs. Preferably, at least one of the end surfaces is spaced apart from its nearest leg to form a relatively small air gap, thus establishing a magnetic circuit with high magnetic permeability. Accordingly, the number of turns of the primary winding can be reduced. The present invention thus incorporates, in combination, a MLT-reducing circular core structure with a turn-reducing high magnetic permeability magnetic return path.

In an alternate embodiment, the C-shaped structure is replaced with a magnetically-permeable shield. The shield includes a main, U-shaped section and a pair of end caps configured to close opposing ends of the U-shaped section to define an closed interior having an opening to access the interior. The interior is configured to house the central components described above. In a preferred embodiment, the interior is filled with epoxy potting material to encapsulate the interior components. The shield includes tabs configured to retain the encapsulated components in the interior of the shield.

Other aspects, features and advantages are also presented.

BRIEF DESCRIPTION OF THE DRAWINGS

The present invention will now be described by way of example, with reference to the accompanying drawings.

DETAILED DESCRIPTION OF THE PREFERRED EMBODIMENT

Figure 1:
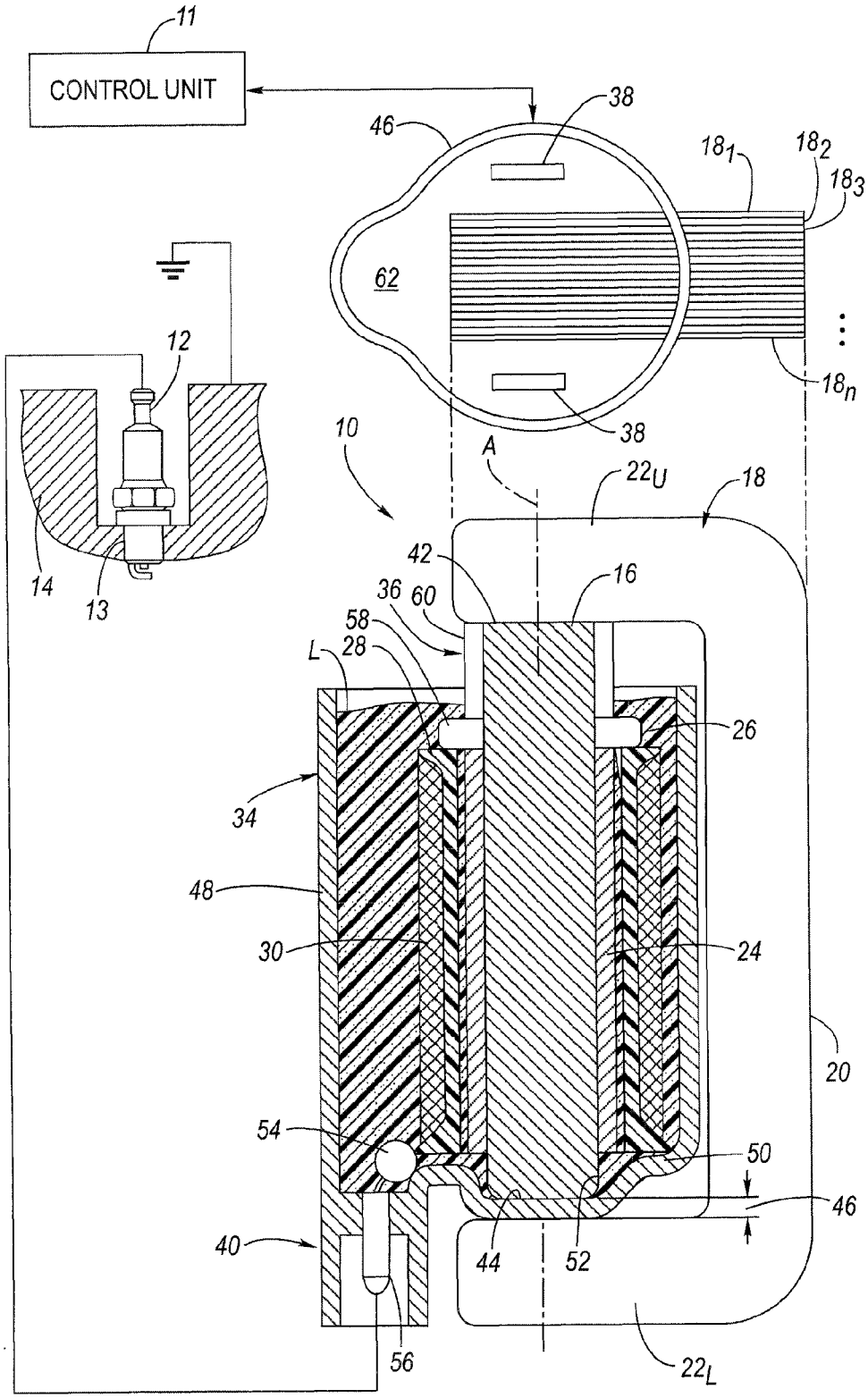
FIG. 1 is a simplified side view, with portions shown in cross-section, of a first embodiment of an ignition apparatus according to the present invention.

Referring now to the drawings wherein like reference numerals are used to identify identical components in the various views, FIG. 1 (first embodiment) is a simplified side view, with portions shown in cross-section, of an ignition apparatus 10. The ignition apparatus 10 may be controlled by a control unit 11 or the like. The ignition apparatus 10 is configured for connection to a spark plug 12 that is in threaded engagement with a spark plug opening 13 into a combustion cylinder in an internal combustion engine 14. The ignition apparatus 10 is configured to output a high-voltage (HV) output to the spark plug 12, as shown. Generally, overall spark timing (dwell control) and the like is provided by the control unit 11. One ignition apparatus 10 may be provided per spark plug 12.

The ignition apparatus 10 may include a magnetically-permeable core 16, optional first and/or second magnets (not shown) at one or both ends of the core 16, a magnetically-permeable structure 18 configured to provide a high permeance magnetic return path, and which has a base section 20 and a pair of legs $\mathbf{22}_U$ and $\mathbf{22}_L$, a primary winding 24, a quantity of encapsulant, such as an epoxy potting material 26 filed up to a level "L", a secondary winding spool 28, a secondary winding 30, a case 34, a cap assembly 36 having primary winding terminals 38 and a high-voltage (HV) tower 40.

The magnetically-permeable core 16 extends along a longitudinal axis "A", is generally cylindrical in overall shape and includes a pair of end surfaces 42 and 44 at upper and lower, axially-opposite ends. The core 16 may comprise conventionally-used materials and construction approaches, as respectively shown for a first and a second variation in FIGS. 2 and 3, respectively. It warrants emphasizing that both variations have a circular shape in radial cross-section, thereby reducing the mean length per turn (MLT) of both the primary winding 24 and the secondary winding 30, as described in the Background. Other variations are possible and remain within the spirit and scope of the present invention.

Figure 2:
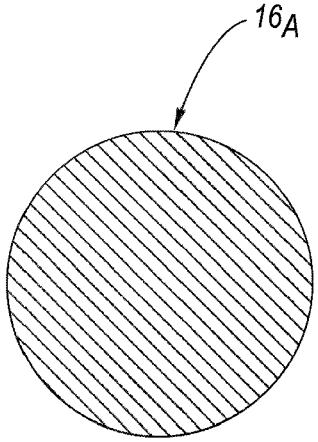
FIG. 2 is a radial cross-sectional view of the core of FIG. 1 formed of compressed insulated iron particles.

FIG. 2 is a cross-sectional view of a magnetic core in a first variation comprising insulated iron particles compression molded into a desired shape, designated as core $\mathbf{16}_A$. The use of compressed insulated iron particles for magnetic cores in various ignition devices is well known in the art, and hence will not be described in any greater detail. As illustrated, the core $\mathbf{16}_A$ has a generally circular shape. The embodiment of FIG. 2 allow for the primary winding 24 to be wound directly on the outer surface of the core $\mathbf{16}_A$.

Figure 3:
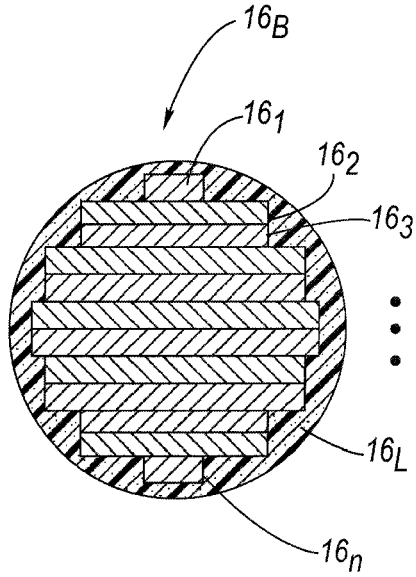
FIG. 3 is a radial cross-sectional view of the core of FIG. 1 formed of a plurality of steel laminations.

FIG. 3 is a cross-sectional view of a magnetic core in a second variation, which is designated as core $\mathbf{16}_B$. The core $\mathbf{16}_B$ comprises a plurality of silicon steel laminations, designated $\mathbf{16}_1$, $\mathbf{16}_2$, $\mathbf{16}_3$, . . . $\mathbf{16}_n$. For core $\mathbf{16}_B$, preferably, a layer $\mathbf{16}_L$ of tape, a shrink tube or other coating of electrical-insulating material is used to protect the primary winding 24 from the sharp edges of the laminations $\mathbf{16}_1$, $\mathbf{16}_2$, $\mathbf{16}_3$, . . . $\mathbf{16}_n$. The embodiment of FIG. 3 allow for the primary winding 24 to be wound on the outer surface of the layer $\mathbf{16}_L$. As with the embodiment of FIG. 2, the core $\mathbf{16}_B$ has a generally circular shape.

Referring again to FIG. 1, the ignition apparatus 10 may use magnets (not shown) at one or both of the ends 42, 44 of the core 16. As known in the art, such magnets may be optionally included in the ignition apparatus 10 as part of the magnetic circuit, and provide a magnetic bias for improved performance. The construction of such magnets (if included), as well as their use and effect on performance, is well understood by those of ordinary skill in the art. It should be understood that round magnets, in general, are less expensive to manufacture than rectangular magnets, and if used at one or both ends of the core 16, would allow for a reduced size core. As a result, using such magnets would provide an even further reduction in the amount of copper wire used in the ignition apparatus 10.

The structure 18 is configured to provide a high permeance magnetic return path for the magnetic flux produced in the core 16 during operation of the ignition apparatus 10. The structure 18 may be formed, for example, from a conventional (standard) lamination stack that includes a plurality of silicon steel laminations $\mathbf{18}_1$, $\mathbf{18}_2$, $\mathbf{18}_3$, . . . $\mathbf{18}_n$ or other adequate magnetic material (i.e., magnetically-permeable material), roughly in the form of a C-shape. The C-shaped structure 18 includes a base portion 20, from which extends upper and lower legs $\mathbf{22}_U$ and $\mathbf{22}_L$. Generally, the structure 18 is square or rectangular (i.e., quadrilateral) in cross-section.

The core 16 is positioned relative to the C-shaped structure 18 such that the end surfaces 42 and 44 face respective legs $\mathbf{22}_U$ and $\mathbf{22}_L$. In the illustrated embodiment, the end of the core 16 that exits the epoxy potting material 26 mates with the upper leg of the C-shape structure (i.e., the upper end surface 42 of the core 16 engages the upper leg $\mathbf{22}_U$). The lower end surface 44, on the other hand, is spaced apart from the lower leg $\mathbf{22}_L$ by a predetermined distance 46 defining an "air" gap. The core 16, in combination with the C-shaped structure 18, in view of the tightly controlled air gap 46, form a magnetic circuit having a high magnetic permeability. The typical range for an air gap is 0.5 to 2 mm. To maximize energy stored, the gap should be large enough to keep the core from saturating to the normal operating current, or level of ampere-turns (primary current×primary turns). As described above, this construction lowers the overall number of turns of the primary winding needed to achieve performance comparable to that of "open" magnetic circuit configuration.

The primary winding 24, as described above, may be wound directly onto the core 16 in a manner known in the art. The primary winding 24 includes first and second ends that are connected to the primary terminals 38 in the cap assembly 36. The winding 24 is configured to carry a primary current $I_P$ for charging the ignition apparatus 10 upon control of the ignition control 11 (as known). The primary winding 24 may comprise copper, insulated magnet wire, with a size typically between about 20-23 AWG. The primary winding 24 may be implemented using known approaches and conventional materials.

The encapsulant 26 may be suitable for providing electrical insulation within the ignition apparatus 10. In a preferred embodiment, the encapsulant 26 may comprise an epoxy potting material. Sufficient epoxy potting material 26 is introduced in the ignition apparatus 10, in the illustrated embodiment, to fill the interior of the case 34 up to approximately the level designated "L". The potting material 26 also provides protection from environmental factors which may be encountered during the service life of the ignition apparatus 10. There are a number of suitable epoxy potting materials known in the art.

The secondary winding spool 28 is configured to receive and retain the secondary winding 30. The spool 28 is disposed adjacent to and radially outwardly of the central components comprising the magnetic core 16 and the primary winding 24 and, preferably, is in coaxial relationship therewith. The spool 28 may comprise any one of a number of conventional spool configurations known to those of ordinary skill in the art. In the illustrated embodiment, the spool 28 is configured to receive one continuous secondary winding (e.g., progressive winding). However, it should be understood that other known configurations may be employed, such as, for example only, a configuration adapted for use with a segmented winding strategy (e.g., a spool of the type having a plurality of axially spaced ribs forming a plurality of channels there-between for accepting windings). The spool 28 may be formed generally of electrical insulating material having properties suitable for use in a relatively high temperature environment. For example, the spool 28 may comprise plastic material such as PPO/PS (e.g., NORYL available from General Electric) or polybutylene terephthalate (PBT) thermoplastic polyester. It should be understood that there are a variety of alternative materials that may be used for the spool 28.

The secondary winding 30 includes a low voltage end and a high voltage (HV) end. The low voltage end may be connected to ground by way of a ground connection through the cap assembly 36 or in other ways known in the art. The high voltage end is connected to a high-voltage (HV) terminal 54, a metal post or the like that may be formed in the secondary spool 28 or elsewhere. The secondary winding 30 may be implemented using conventional approaches and material (e.g., copper, insulated magnet wire) known to those of ordinary skill in the art.

The case 34 is formed of electrical insulating material, and may comprise conventional materials known to those of ordinary skill in the art (e.g., the PBT thermoplastic polyester material referred to above). The case 34 includes a generally circumferentially-extending sidewall 48 projecting from a floor 50 to form an interior space that is accessed via an upper opening of the case 34 (i.e., near the cap assembly 36). The interior space is configured in size and shape to accommodate the central components, namely the core 16, the primary winding 24, the secondary spool 28 and the secondary winding 30. The floor 50 includes a recess 52 configured in size and shape to locate and seat the lower end surface 44 of the core 16. In addition, the thickness of the floor 50 in the area of the recess 52 defines the air gap 46. Since the case is formed of non-magnetically-permeable material, the spacing 46 is effectively an "air" gap from a magnetic point of view.

The case 34, in the illustrative embodiment, may also include the HV tower 40 described above. In this regard, the tower 40 includes a high voltage, electrically-conductive connector 56 of conventional configuration. The connector 56 is electrically connected to the HV terminal 54 on the inboard side of the case 34 to thereby bridge the HV end of the secondary winding 30 to the HV connector 56. A conventional HV cable (shown diagrammatically in phantom line in FIG. 1), which is replaceable, may be used to deliver the high voltage (spark voltage) produced from the ignition apparatus 10 to the spark plug 12.

With continued reference to FIG. 1, the cap assembly 36 is positioned near the upper opening of the case 34 that provides access to the interior space of the case 34. The cap assembly 36 includes a base portion 58, and a neck portion 60.

The cap assembly 36 includes a central through-bore sized to snugly fit over the core 16, as illustrated, in an interference fit fashion. Since the end of the core 16 that exits the epoxy material 26 is covered by the cap assembly 36 (i.e., an extension of the primary cap 62), the cap assembly 36 is effective to relieve mechanical hoop stress that would otherwise exist around the core 16. It also warrants noting that although one end of the core 16 exits the surface of the epoxy material 26, any axial stress is relieved because the core 16 is isolated from the epoxy material 26 by virtue of the taping/layer $\mathbf{16}_L$ between the primary winding and the magnetic core. For magnetic cores formed of compressed, insulated iron particles, such cylindrical composite iron cores may be compacted with a graphite lubricant sprayed on the compaction tool, or with an internal lubricant (e.g., a lubricant commercially available under the trademark ACRAWAX, comprising N,N'-Ethylenebisstearamide and stearic acid, from IMS Company, Chagrin Falls, Ohio, USA). Either lubricant prevents adhesion to the epoxy minimizing stress.

The cap assembly 36 generally is formed using electrical insulating material, which may be the same as used for the case 34. As described above, the cap assembly 36 includes a pair of electrically-conductive primary terminals 38, which allow (1) connections to the respective ends of the primary winding 24 (on the inboard side of the case), and also (2) to permit external connections from the ignition apparatus 10 to the control 11. It is through this external connection that the control 11, among other things, electrically connects the first and second ends of the primary winding 24 to an energization source, such as, the energization circuitry included in the ignition control system 11.

Figure 4:
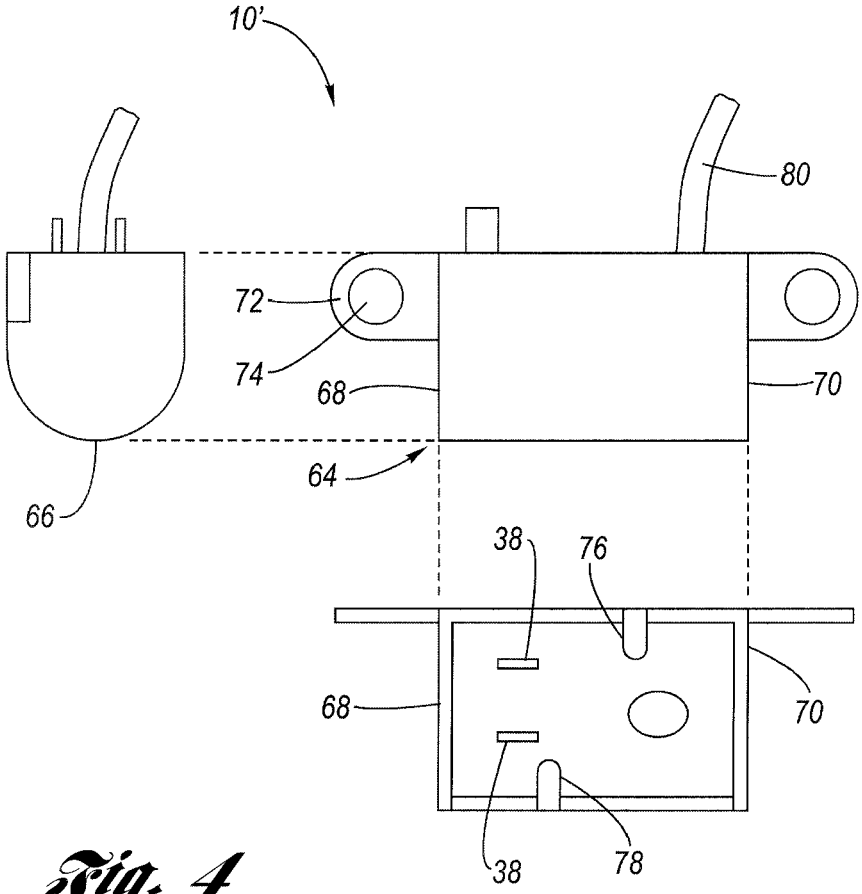
FIG. 4 is a simplified plan view of a second embodiment of an ignition apparatus according to the present invention.

FIG. 4 is a simplified plan view of a second embodiment of an ignition apparatus of the present invention, designated 10'. Unless otherwise described, the ignition apparatus 10' is the same as ignition apparatus 10 except that the C-shaped structure 18 is replaced with a formed shield 64. In addition, the shield 64 is configured so as to eliminate the need for the plastic case 34.

The shield 64 includes a main section 66 (e.g., U-shaped as illustrated), a pair of end caps 68, 70, optional mounting flanges 72 and respective apertures 74, and a plurality of retaining tabs 76, 78. The U-shaped section 66 and the end caps 68, 70 may be stamped and joined together, for example by way of welding or other conventional joining process. Alternatively, the shield 64 may comprise a drawn part so as to eliminate the need for welding the end caps 68, 70 in place.

In one embodiment, the shield 64 comprises carbon steel material, such as American Iron and Steel Institute (AISI) 1008 carbon steel, in which case, preferably, the shield is subsequently E-coated for corrosion protection as an assembly. The E-coating (i.e., an electrophoretically-deposited coating) may be performed in accordance with conventional approaches known in the art. For example, for general information concerning E-coating see the description in the Background of U.S. Pat. No. 6,428,645 entitled "VEHICULAR MOUNT ASSEMBLY WITH BONDED RUBBER" issued to Rau et al., assigned to the common assignee of the present invention and hereby incorporated by reference for such purpose. In an alternate embodiment, the shield 64 may comprise 400 series stainless steel material, in which embodiment the E-coat can be eliminated.

Mounting flanges 72 (and apertures 74), if provided, may be used to secure the ignition apparatus 10' using conventional fasteners.

In the embodiment where E-coating is used, the shield 64, preferably main U-shaped section 66, includes a plurality of tabs (e.g., two tabs 76, 78 are shown) that are configured to be bent over the surface of the potting material 26 after the epoxy potting material has cured. The plurality of tabs 76, 78 perform the function of retaining the encapsulated components (e.g., the core, the windings, etc.) in the interior of the shield 64, since the any E-coating may diminish the ability of the epoxy potting material 26 to adhere to the shield 64.

The HV end of the secondary winding 30 may be taken out of the shield 64 by way of a dedicated HV cable 80, as shown.

Alternatively, an HV tower (like HV tower 40) can be provided, which allows for a replaceable (i.e., serviceable) HV cable to be used.

While particular embodiments of the invention have been shown and described, numerous variations and alternate embodiments will occur to those skilled in the art. Accordingly, it is intended that the invention be limited only in terms of the appended claims.

The invention claimed is:

1. An ignition apparatus for an internal combustion engine, comprising:

a magnetically-permeable core extending along an axis, said core having a circular shape in radial cross-section and having a pair of end surfaces on axially-opposite ends thereof;

a primary winding disposed outwardly of said core;

a secondary winding disposed outwardly of said primary winding;

a structure comprising magnetically-permeable steel laminations having a base and a pair of legs, said structure defining a magnetic return path;

wherein said core is disposed between said pair of legs whereby said axis extends through said legs and said end surfaces face toward said legs and at least one of said end surfaces of said core is spaced axially apart from a respective one of said legs to define an air gap.

2. The apparatus of claim 1 wherein said structure is a C-shaped structure.

3. The apparatus of claim 1 further including a case comprising electrically-insulating material and configured to receive said core, said case including a floor with a recess portion disposed in and defining said air gap.

4. The apparatus of claim 1 wherein said core comprises compressed insulated iron particles.

5. The apparatus of claim 4 wherein said primary winding is wound directly on said core.

6. The apparatus of claim 1 wherein said magnetically-permeable steel laminations of the structure define a first plurality of laminations, said core comprising a second plurality of magnetically-permeable steel laminations, said ignition apparatus further including a layer of electrical-insulating material disposed directly on said core, said primary winding being disposed on said layer.

7. The apparatus of claim 1 further including a secondary spool comprising electrical-insulating material and configured to receive and retain said secondary winding, said spool being disposed radially-outwardly of said primary winding.

8. The apparatus of claim 7 further comprising a case formed of electrically-insulating material and configured to receive said core, said case further including a high-voltage tower having a high-voltage connector coupled to receive a high voltage output produced at a high-voltage end of said secondary winding.

9. The apparatus of claim 8 wherein said case includes an interior space configured to house said core, said secondary spool and said primary and secondary windings, said interior space being filled with an epoxy potting material to a predetermined level, one of said end surfaces of said core projecting axially beyond said predetermined level.

10. The apparatus of claim 9 wherein said case further includes an opening for accessing said interior space, said apparatus further including a cap assembly configured to surround and engage a portion of said core.

11. The apparatus of claim 1 further comprising at least one round magnet disposed on one of the end surfaces of said core.

12. An ignition apparatus for an internal combustion engine, comprising:

a magnetically-permeable core extending along an axis, said core having a circular shape in radial cross-section and having a pair of end surfaces on axially-opposite ends thereof;

a primary winding disposed outwardly of said core;

a secondary winding disposed outwardly of said primary winding;

a shield comprising magnetically-permeable material defining a magnetic return path, said shield having a main, U-shaped section and a pair of end caps configured to define an interior, said shield including an opening for accessing said interior, said interior configured to house said core, said primary winding and said secondary winding.

13. The apparatus of claim 12 wherein said interior is filled with epoxy potting material to encapsulate said core and primary and secondary windings, at least one of said U-shaped section and said end caps include tabs configured to retain said encapsulated core and windings in said shield interior.

14. The apparatus of claim 12 wherein said shield comprises one of carbon steel material and stainless steel material.

15. The apparatus of claim 14 wherein said shield comprises carbon steel material, and wherein said shield is E-coated for corrosion protection.

16. The apparatus of claim 14 wherein said shield comprises 400 series stainless steel material.

* * * * *